US009194197B2

(12) United States Patent
Smith et al.

(10) Patent No.: US 9,194,197 B2
(45) Date of Patent: Nov. 24, 2015

(54) MECHANICAL COUNTER

(71) Applicant: Petrowell Limited, Dyce, Aberdeen (GB)

(72) Inventors: Colin Smith, Aberdeen (GB); Daniel George Purkis, Aberdeen (GB)

(73) Assignee: PETROWELL LIMITED, Aberdeen (GB)

( * ) Notice: Subject to any disclaimer, the term of this patent is extended or adjusted under 35 U.S.C. 154(b) by 488 days.

(21) Appl. No.: 13/627,645

(22) Filed: Sep. 26, 2012

(65) Prior Publication Data

US 2013/0186644 A1 Jul. 25, 2013

Related U.S. Application Data

(63) Continuation of application No. PCT/GB2011/050469, filed on Mar. 10, 2011.

(51) Int. Cl.

| | |
|---|---|
| ***E21B 23/04*** | (2006.01) |
| ***E21B 23/00*** | (2006.01) |
| ***E21B 21/10*** | (2006.01) |
| ***E21B 34/14*** | (2006.01) |

(52) U.S. Cl.

CPC ..... *E21B 23/00* (2013.01); *E21B 21/103* (2013.01); *E21B 23/004* (2013.01); *E21B 23/04* (2013.01); *E21B 34/14* (2013.01)

(58) Field of Classification Search

CPC ..... E21B 23/004

See application file for complete search history.

(56) References Cited

U.S. PATENT DOCUMENTS

| | | | |
|---|---|---|---|
| 3,211,226 | A | 10/1965 | Myers et al. |
| 7,322,417 | B2 | 1/2008 | Rytlewski et al. |
| 7,377,321 | B2 | 5/2008 | Rytlewski |
| 7,387,165 | B2 | 6/2008 | Lopez de Cardenas et al. |
| 7,581,596 | B2 | 9/2009 | Reimert et al. |
| 7,661,478 | B2 | 2/2010 | Palmer et al. |
| 2002/0074128 | A1 | 6/2002 | Allamon et al. |
| 2003/0136563 | A1 | 7/2003 | Allamon et al. |
| 2004/0118564 | A1 | 6/2004 | Themig et al. |
| 2007/0102163 | A1 | 5/2007 | Heath et al. |
| 2009/0308588 | A1 | 12/2009 | Howell et al. |
| 2010/0282338 | A1 | 11/2010 | Gerrard et al. |

(Continued)

FOREIGN PATENT DOCUMENTS

| | | | |
|---|---|---|---|
| GB | 2314106 | A | 12/1997 |
| GB | 2377234 | A | 1/2003 |

(Continued)

OTHER PUBLICATIONS

Written Opinion of the International Searching Authority received in corresponding PCT Application No. PCT/GB2011/050469.

(Continued)

*Primary Examiner* — Giovanna C Wright

(74) *Attorney, Agent, or Firm* — Blank Rome LLP

(57) ABSTRACT

A mechanical counting device for actuating a plurality of output devices, the device comprising: linear indexing means adapted to count a plurality of actuating signals and to cause actuation of the output devices when a predetermined number of actuating signals for each output device has been received, wherein the mechanical counting device is adapted to cause actuation of a particular device when a different predetermined number of actuating signals has been received such that the output devices are sequentially actuable.

24 Claims, 7 Drawing Sheets

(56) References Cited

U.S. PATENT DOCUMENTS

| | | | | |
|---|---|---|---|---|
| 2010/0294514 | A1 | 11/2010 | Crow et al. | |
| 2010/0294515 | A1 | 11/2010 | Xu | |
| 2011/0067888 | A1 | 3/2011 | Mireles | |
| 2011/0203800 | A1 * | 8/2011 | Tinker et al. | 166/318 |
| 2011/0240301 | A1 | 10/2011 | Robinson et al. | |
| 2011/0240311 | A1 | 10/2011 | Robison et al. | |
| 2011/0278017 | A1 | 11/2011 | Themig et al. | |
| 2012/0048556 | A1 | 3/2012 | O'Connell et al. | |

FOREIGN PATENT DOCUMENTS

| | | | |
|---|---|---|---|
| WO | 2011117601 | A2 | 9/2011 |
| WO | 2011117602 | A2 | 9/2011 |

OTHER PUBLICATIONS

Written Opinion of the International Searching Authority received in corresponding PCT Application No. PCT/GB2011/050467.

* cited by examiner

MECHANICAL COUNTER

CROSS-REFERENCE TO RELATED APPLICATIONS

This application is a continuation of PCT/GB2011/050469, filed Mar. 10, 2011, which claims priority to United Kingdom Patent Application No. GB 1005149.8, filed on Mar. 26, 2010, the contents of each one incorporated herein by reference.

FIELD OF THE INVENTION

The present invention relates to mechanical devices for counting input signals. In particular, the invention relates to mechanical devices for counting input signals to actuate downhole tools in a sequential manner.

BACKGROUND OF THE INVENTION

There are many situations in which downhole tools must be selectively actuated. However, communicating with the tools to cause actuation can be difficult in the downhole environment. Systems such as RFID systems exist but these are complex, expensive and prone to failure. Indeed, any form of electrical, electronic or magnetic device is often not robust enough to withstand the harsh downhole environment.

During hydraulic fracturing of a multiple zone well, a series of tools, or clusters of tools, are provided at each zone, and each downhole tool needs to be actuated and fluid is diverted to flow outwards to fracture the well. The actuation must be performed in a sequential manner to allow the borehole to be progressively fractured along the length of the bore, without leaking fracture fluid out through previously fractured regions.

Due to the expense and frequent failure of electronic or electrical devices, the most common approach to tool actuation is still fully mechanical. Balls of ever increasing size are dropped down a tubular positioned within the well bore. The tools are configured so that the first dropped ball, which has the smallest diameter, passes though the first and intermediate tools, which have a ball seat (hereinafter referred to as a valve seat) larger than the ball, until it reaches the furthest away tool in the well. This furthest away tool is configured to have a valve seat smaller than the first dropped ball so that the ball seats at the tool to block the main passage and cause transverse ports to open thus diverting the fluid flow. Subsequently dropped balls are of increasing size so that they too pass through the nearest tools but seat at further away tools which have a suitably sized valve seat. This is continued until all the tools have been actuated in the order of furthest away to nearest.

Therefore, this approach does not involve counting the dropped balls. Balls which are too small for a particular tool are simply not registered. However, this approach has a number of disadvantages. The number of tools with varying valve seats that can be used is limited in practice because there must be a significant difference in the size of the seat (and therefore the ball) so that the ball does not inadvertently actuate previous tools. Also, the valve seats act as restrictions to flow within the tubular which are always undesirable. The smaller the seat the greater the restriction.

It is desirable to provide an apparatus which allows: actuation of a large number of downhole tools; and/or downhole tools with the same size of valve seat; and/or valve seats with the largest possible diameter.

SUMMARY OF THE INVENTION

According to a first aspect of the present invention there is provided a mechanical counting device locatable at each of a plurality of downhole tools arranged within and along a well bore, each tool having a main bore corresponding to tubular positioned in the well bore, and each tool being actuatable to open one or more fluid ports which are transverse to the main bore, the mechanical counting device comprising:

linear indexing means adapted to cause the mechanical counting device to linearly progress along the main bore by a predetermined distance in response to receiving an object dropped down the well bore until reaching an actuation site of the tool whereupon the tool is actuated, wherein the mechanical counting device is locatable at a plurality of different predetermined positions within the main bore such that the downhole tools are sequentially actuatable.

The mechanical counting device may be adapted to engage with one of a plurality of longitudinal recesses provided along the main bore.

The mechanical counting device may be adapted, upon reaching the actuation site, to cause the dropped object to stop at the tool, thus blocking the main bore at the tool.

The mechanical counting device may be adapted to linearly progress in a number of discrete steps to the actuation site. Each discrete steps may correspond to the mechanical counting device moving from one longitudinal recess to the adjacent longitudinal recess.

The mechanical counting device may comprise a collet member having a number of fingers and a protrusion provided at the end of each finger. Each finger may be flexible. The collet member may comprise a tubular member having a bore which is sized such that the dropped object may pass through the tubular member. Each finger may be movable between a first position in which the protrusion is outwith the bore of the tubular member and a second position in which the protrusion is within the bore of the tubular member and contactable by the dropped object. Each finger may be bendable between the first and second positions.

The collet member may be locatable within the main bore such that the protrusion of one or more fingers is engaged with a recess when the finger is at the first position and not engaged with a recess when the finger is at the second position.

The collet member may comprise a first set of fingers and a second set of fingers which is longitudinally spaced from the first set. The collet member and the recesses may be configured such that, when the fingers of the first set are engaged with a recess, the fingers of the second set are not engaged with a recess. The collet member and the recesses may be configured such that, when the fingers of the second set are engaged with a recess, the fingers of the first set are not engaged with a recess.

The collet member may be adapted such that the dropped object passing through the main bore contacts the protrusion of the one or more fingers which are at the second position such that the collet member is linearly moved in the direction of travel of the dropped object. The collet member may be linearly moved until the protrusion engages with the next recess. The collet member may be adapted such that engagement with the next recess allows the dropped object to continue past the set of fingers of which the protrusion has engaged with the next recess.

The collet member may be adapted such that the linear movement causes the protrusion of the one or more fingers which are at the first position to disengage from the recess and move to the second position. The collet member may be linearly moved by the impact force from the dropped object and/or by fluid pressure upstream of, and acting on, the dropped object.

In this manner, the collet member is linearly movable in a stepwise sequence, moving one recess every time an object is dropped.

The mechanical counting device may be movable towards a sleeve member provided within the main bore and adapted to block the transverse ports. The collet member may be adapted to contact and act upon the sleeve member upon reaching the actuation site to move the sleeve member and cause fluid communication between the main bore and the transverse ports.

In this manner, the collet member is linearly movable one recess at a time towards the actuation site whereupon it causes moving of the sleeve member to open the transverse ports. The main bore of each tool can be provided with a large number of recesses. For a particular tool, the collet member can be located a particular number of recesses from the actuation site. The number of recesses can be arranged to vary for each tool depending on its proximity to the surface. For instance, the tool furthest from the surface could have the least number of recesses, such as only one, while the tool nearest the surface could have the greatest number of recesses, such as fifty if there is a total of fifty tools within the well bore. The tools will therefore sequentially actuate in the order of furthest away to nearest.

BRIEF DESCRIPTION OF THE DRAWINGS

Embodiments of the present invention will now be described, by way of example only, with reference to the accompanying drawings in which.

DETAILED DESCRIPTION OF DRAWINGS

Figure 1:
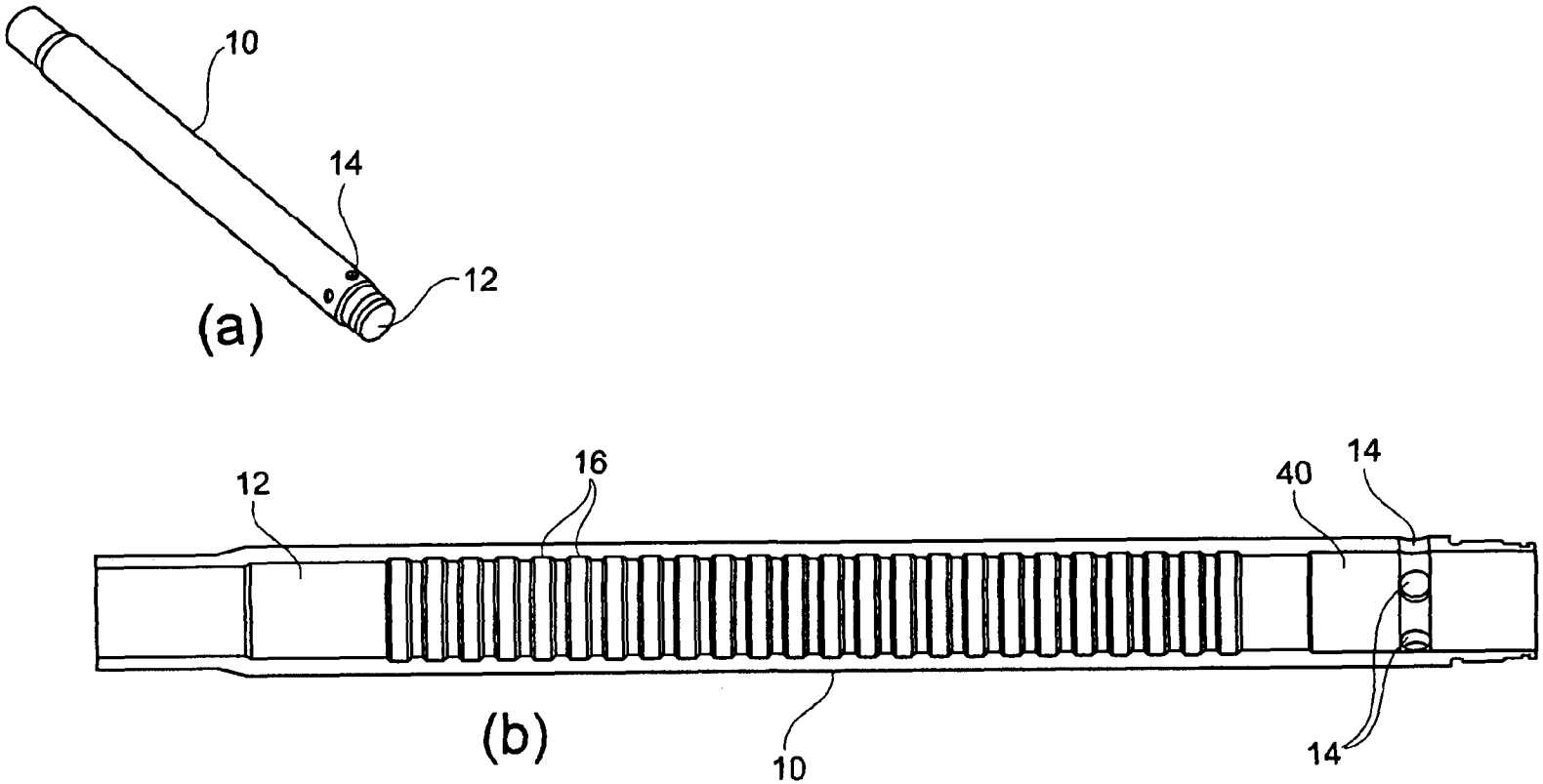
FIG. 1 is a (a) perspective view and a (b) sectional side view of a housing of a tool (shown in FIG. 3) of a downhole actuating apparatus.

FIG. 1 shows a downhole tool 10 of a downhole actuating apparatus. The apparatus comprises many of these downhole tools 10, such as fifty, which can be secured to a tubular and sequentially arranged along a well bore. As utilized throughout this specification, the term "tubular" refers to any generally tubular conduit for transporting fluid, particularly oil, gas and/or water, in and/or from a subterranean well. A "tubular" as deployed in a subterranean well, may be formed from individual, discrete lengths of generally tubular conduit usually secured together by means of collars to form, for example a tubing string, drill string, casing string, liner, etc., which is positioned in a subterranean well and utilized, at least in part, to transport fluids. The tubular may have a bore of a generally uniform diameter throughout the length thereof or may have two or more sections having bores of different diameters. For example, the tubular may be comprised of a casing string positioned within the well bore, extending at one end thereof from the well head, either surface or subsea, and connected at or near the other end thereof to a tubing string or liner having a bore that is smaller than that through the casing string. As another example, the tubular may be comprised of a tubing string positioned within the well bore, extending at one end thereof from the well head, either surface or subsea, and connected at or near the other end thereof to a casing string or liner having a bore that is larger than that through the tubing string. Environments other than a subterranean well in which tubulars may be used in accordance with the present invention, include, but are not limited to, pipelines and sewer lines.

In this embodiment, the tools 10 are provided for the purpose of well fracturing. Each tool 10 has a main bore 12 which in use is coaxial with the tubular positioned within a well bore and a number of transverse fluid ports 14. The main bore 12 of the tool 10 defines a number of annular grooves or recesses 16, the recesses 16 each being equally and longitudinally spaced apart by a predetermined spacing. The number of recesses 16 can be configured to be the same as the total number of tools 10.

Figure 2:
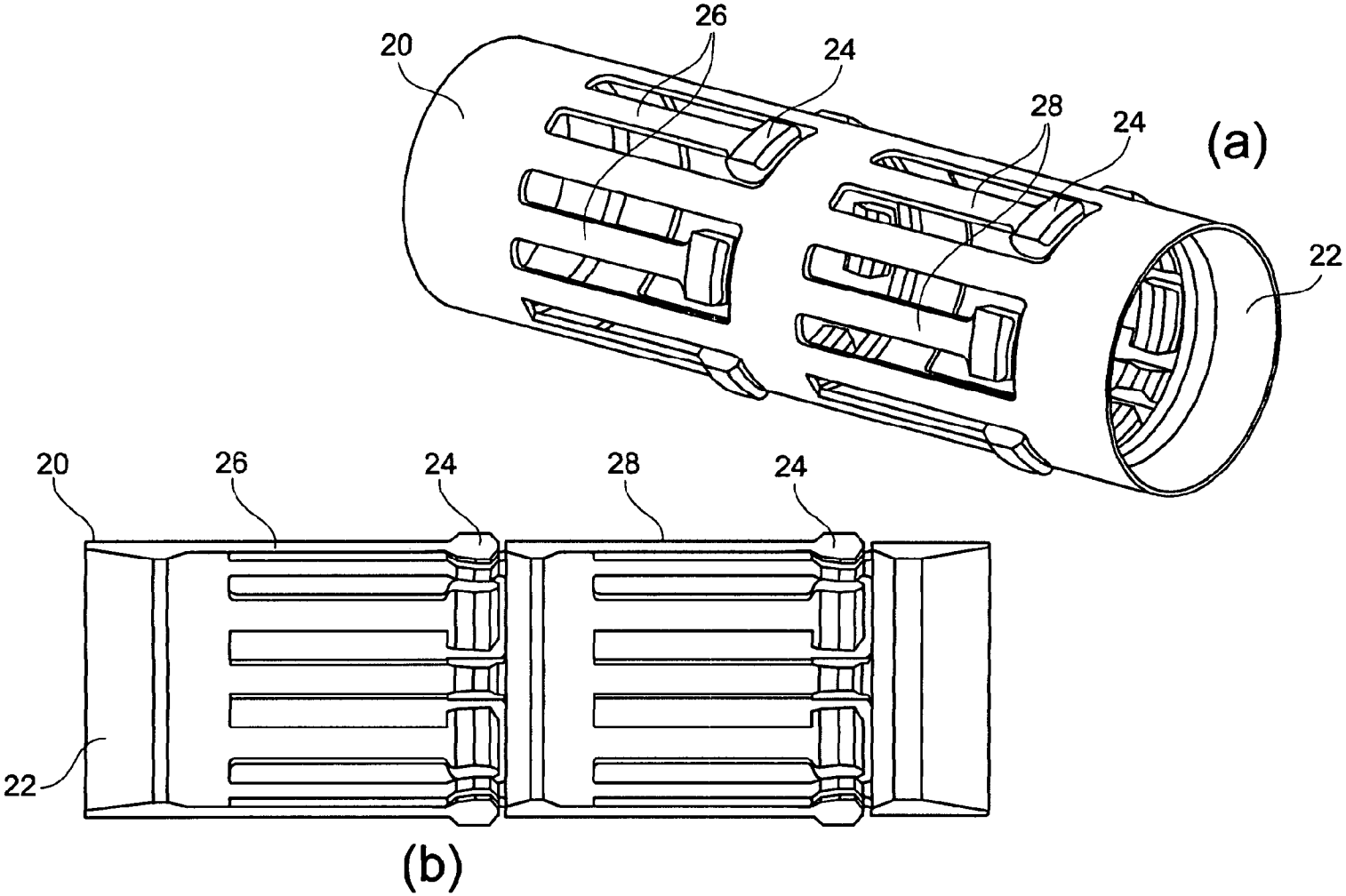
FIG. 2 is a (a) perspective view and a (b) sectional side view of a collet of a downhole actuating apparatus.

Inserted within the main bore 12 of each tool 10 is a collet 20 as shown in FIGS. 3 to 7. Referring to FIG. 2, the collet 20 is tubular and has a bore 22 which is coaxial with the main bore 12 when the collet 20 is inserted within the main bore 12. Each collet 20 has two sets of flexible fingers and a protrusion 24 is provided at the end of each finger. Each finger is bendable, when a transverse force is applied to the protrusion 24, between a first position in which the protrusion 24 is outwith the bore 22 of the collet 20 and a second position in which the protrusion 24 is within the bore 22. When the collet 20 is inserted within the main bore 12, each protrusion 24 is at the first position when engaged with a recess 16 and at the second position when the protrusion 24 is not engaged with a recess 16.

The first set of fingers 26 and the second set of fingers 28 are longitudinally spaced apart by a predetermined distance. This distance is configured so that, when the fingers 26 of the first set are engaged with a recess 16, the fingers 28 of the second set are not engaged with a recess 16, rather they are between two adjacent recesses 16 and so at the second position.

The collet 20 is adapted such that a dropped object such as a ball 30 can pass through the main bore 12 but it will contact the protrusion 24 of any fingers which are at the second position. FIGS. 4 to 7 show a ball 30, dropped from the surface and travelling in direction 100, passing through the collet 20.

Figure 4:
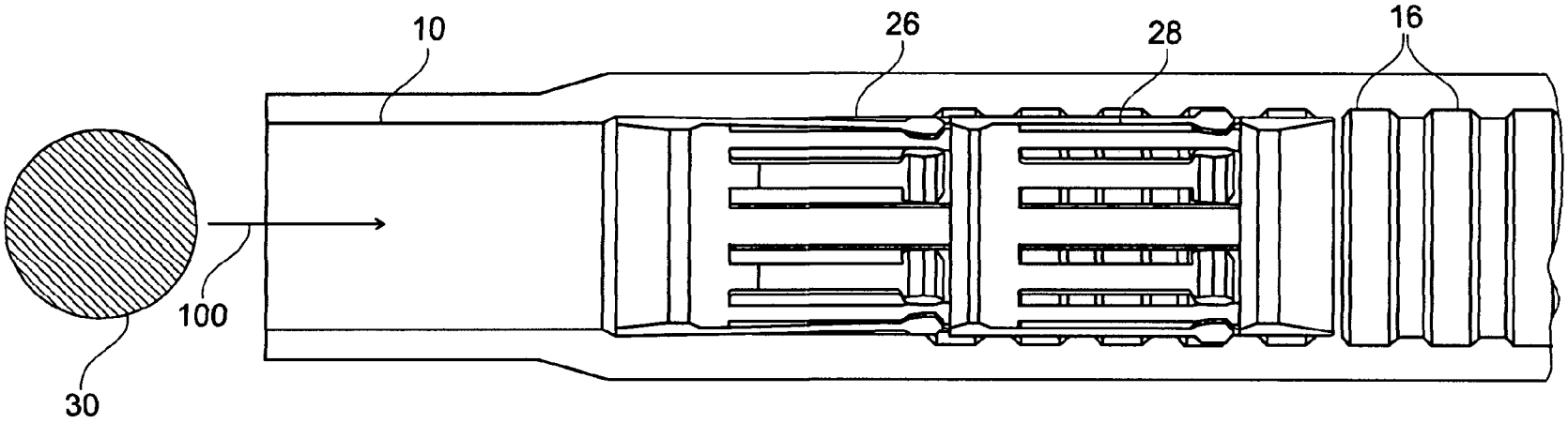
FIG. 4 is a detailed sectional side view of a portion of the tool of FIG. 1 with a ball approaching the tool.

As shown in FIG. 4, each protrusion 24 of the second set of fingers 28 is engaged with a recess 16 and so are unbent and at the first position. However, the protrusions 24 of the first set of fingers 26 are engaged with a recess 16 and so are bent inwards to the second position. It should be noted that the collet 20 could be configured such that the first set of fingers 26 are at the first position and the second set of fingers 28 are at the second position.

Figure 5:
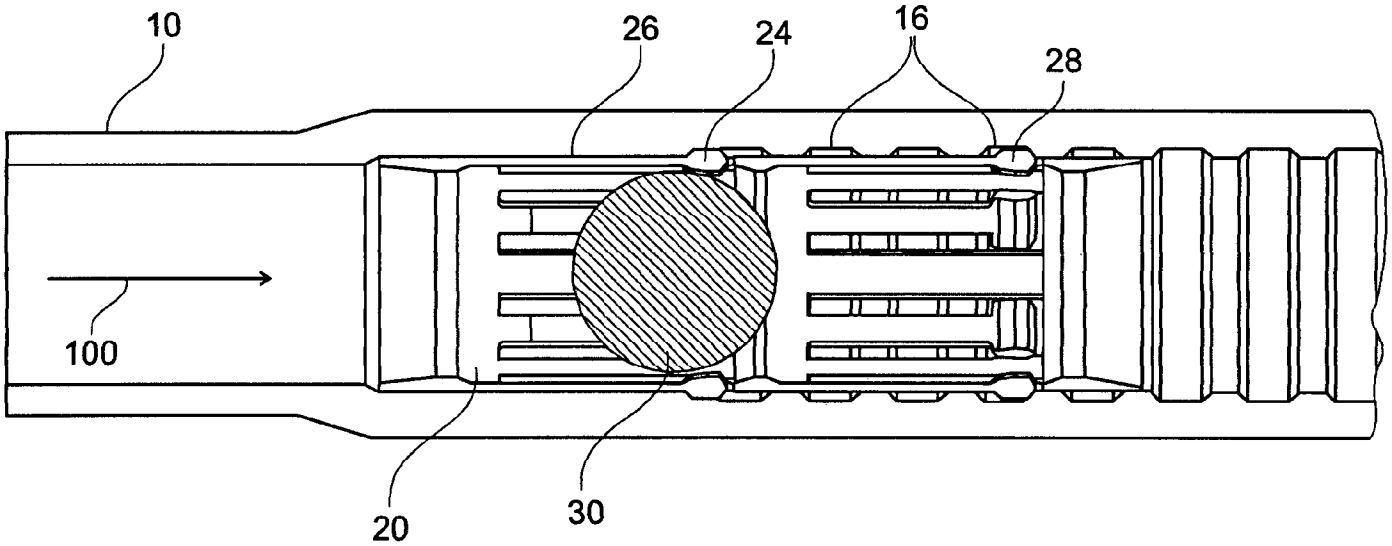
FIG. 5 is a detailed sectional side view of a portion of the tool of FIG. 1 with the ball landing at the first seat.

As shown in FIG. 5, the ball 30 contacts the protrusions 24 of the first set of fingers 26 since they are within the bore 22. One or both of the impact force from the ball 30 and fluid pressure upstream of the ball 30 then causes the collet 20 to be linearly moved in the travel direction 100. This causes the second set of fingers 28 to disengage from the recess 16 and linearly move to a location between this recess 16 and the next recess 16. These fingers 28 are now at the second position. At the same time, the first set of fingers 26 move forward to engage with the next recess 16 causing the fingers 26 to unbend to the first position. The protrusions 24 and recesses 16 are suitably profiled to allow the protrusion 24 to disengage from the recess 16 when a sufficient linear force is applied.

Figure 6:
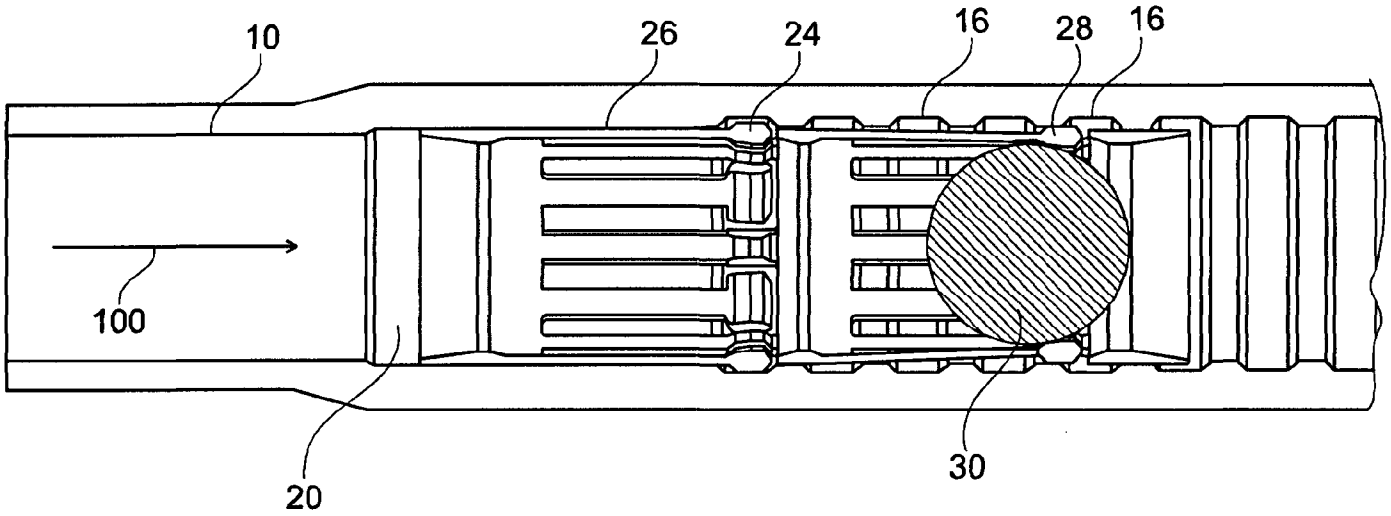
FIG. 6 is a detailed sectional side view of a portion of the tool of FIG. 1 with the ball landing at the second seat.

FIG. 6 shows the fingers in their new positions. Also, with the first set of fingers 26 at the first position, the ball 30 is free to continue its travel until it meets the second set of fingers 28. Since these are now at the second position, the ball 30 is stopped at this location.

Again, the impact force from the ball 30 and/or fluid pressure upstream of the ball 30 causes the collet 20 to be linearly moved in the travel direction 100. This causes the first set of fingers 26 to disengage from the recess 14 and linearly move to a location between this recess 14 and the next recess 14. These fingers 26 are now at the second position. At the same time, the second set of fingers 28 move forward to engage with the next recess 14 causing the fingers 28 to unbend to the first position.

Figure 7:
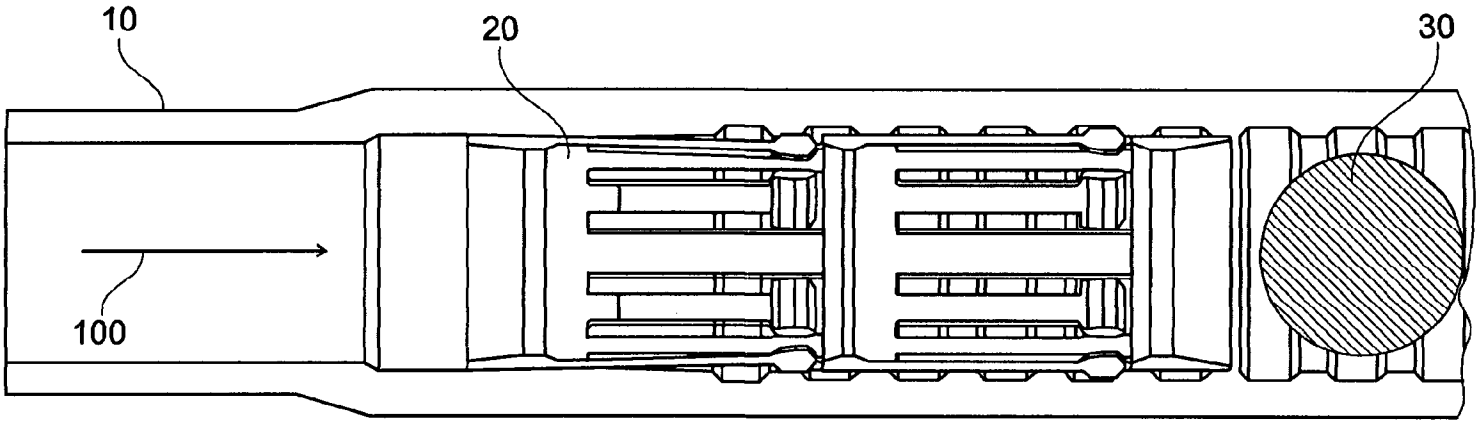
FIG. 7 is a detailed sectional side view of a portion of the tool of FIG. 1 with the ball released.

FIG. 7 shows the fingers in their new positions. It should be noted that these positions are the same as their original positions before the ball 30 approached the collet 20. With the second set of fingers 28 at the first position, the ball 30 is free to continue its travel along the well bore, exiting this tool 10. The ball 30 will continue to travel through a tubular to the next tool 10 where it will drive forward the collet 20 associated with the tool 10 and so on until the last tool is reached.

Therefore, the overall effect of the ball 30 passing through the tools 10 is that the associated collet 20 is linearly moved forward one recess 16. Any subsequently dropped balls 30 would have the same effect. The collet 20 is therefore linearly moved in a stepwise sequence, moving one recess 16 every time a ball 30 is dropped.

Figure 3:
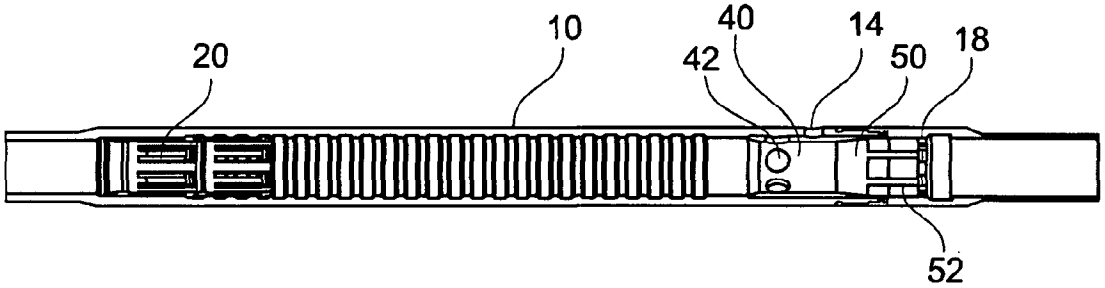
FIG. 3 is a sectional side view of a tool of a downhole actuating apparatus with a sleeve in the closed position.

Each tool 10 includes a sleeve 40, as shown in FIGS. 1 and 3. The sleeve 40 includes a number of apertures 42. In its normal position, the sleeve 40 is connected to the main bore 12 by a connecting member or shear pin and, at this position, the apertures 42 are longitudinally spaced from the transverse ports 14. Therefore, the sleeve 40 blocks the transverse ports 14 to fluid within the main bore 12. FIG. 2 shows this normal position with the transverse ports 14 blocked. Seals are provided to prevent leakage of fluid from the main bore 12 to the transverse ports 14.

As shown in FIG. 3, a second collet 50 is provided within the main bore 12 just downstream of the sleeve 40. With the sleeve 40 in its normal position, the protrusion of the fingers 52 of the second collet 50 are engaged with second recesses 18 provided at the main bore 12. Therefore, the second collet 50 is unaffected by any dropped balls 30 passing through the tool 10.

When a predetermined number of balls 30 have been dropped for the particular tool 10, the collet 20 will have been moved to reach and contact the sleeve 40 and this is termed the actuation site. Further linear movement of the collet 20 applies a longitudinal force on the sleeve 40 to linearly move the sleeve 40 when the force is great enough to cause shearing of the shear pin. This movement of the sleeve 40 causes alignment of the apertures 42 of the sleeve 40 and the transverse ports 14 so that there is fluid communication between the main bore 12 and the transverse ports 14. The movement also causes the sleeve 40 to act upon and linearly move the second collet 50 such that the protrusions of the fingers 52 of the second collet 50 disengage with second recesses 18. A dropped ball 30 will stop at these protrusions and block the main bore 12.

Therefore, the main bore 12 is now blocked and the transverse ports 14 are open. The tool 10 has been actuated and fluid travelling in the well bore in direction 100 will be diverted out of the tool 10 via the transverse ports 14.

The apparatus can be arranged so that the collet 20 is located within the main bore 12 of a particular tool 10 at a predetermined number of recesses 16 from the actuation site. The tools 10 can be arranged so that this predetermined number of recesses 16 varies for each tool 10 depending on its proximity to the surface. The tool 10 furthest from the surface can involve only one recess 16, while the tool 10 nearest the surface could have the greatest number of recesses 16, such as fifty. The tools 10 with a collet 20 which is a smaller number of recesses 16 from the sleeve 40 will actuate first. The tools 10 will therefore sequentially actuate in the order of furthest away to nearest.

Therefore, each tool 10 is provided with indexing means which is adapted to register receipt of an actuating signal (the dropped ball 30) and to cause actuation of the tool 10 when a predetermined number of actuating signals has been received. At least two of the tools 10 is actuated when a different predetermined number of actuating signals has been received and so the downhole tools 10 are sequentially actuatable.

Also, the predetermined number of recesses 14 for each tool 10 corresponds to the predetermined number of actuating signals. This may be an identically correspondence, or the predetermined number of recesses could equal, say, the predetermined number of actuating signals minus one. This would be the case if the collet 20 is moved, say, four recesses 14 to move the sleeve and a fifth ball 30 is used to block the main bore 12 (rather than the fourth ball 30 moving the sleeve before being caught by the second collet 50).

The present invention allows each tool 10 to have a valve seat of the same size and to have a main bore of the same size which is substantially equivalent to the bore through the tubular. Each ball 30 dropped is also the same size. It should also be noted that the mechanical counting device of the present invention is non-electrical, non-electronic and non-magnetic. Rather, it is a fully mechanical apparatus.

Figure 8:
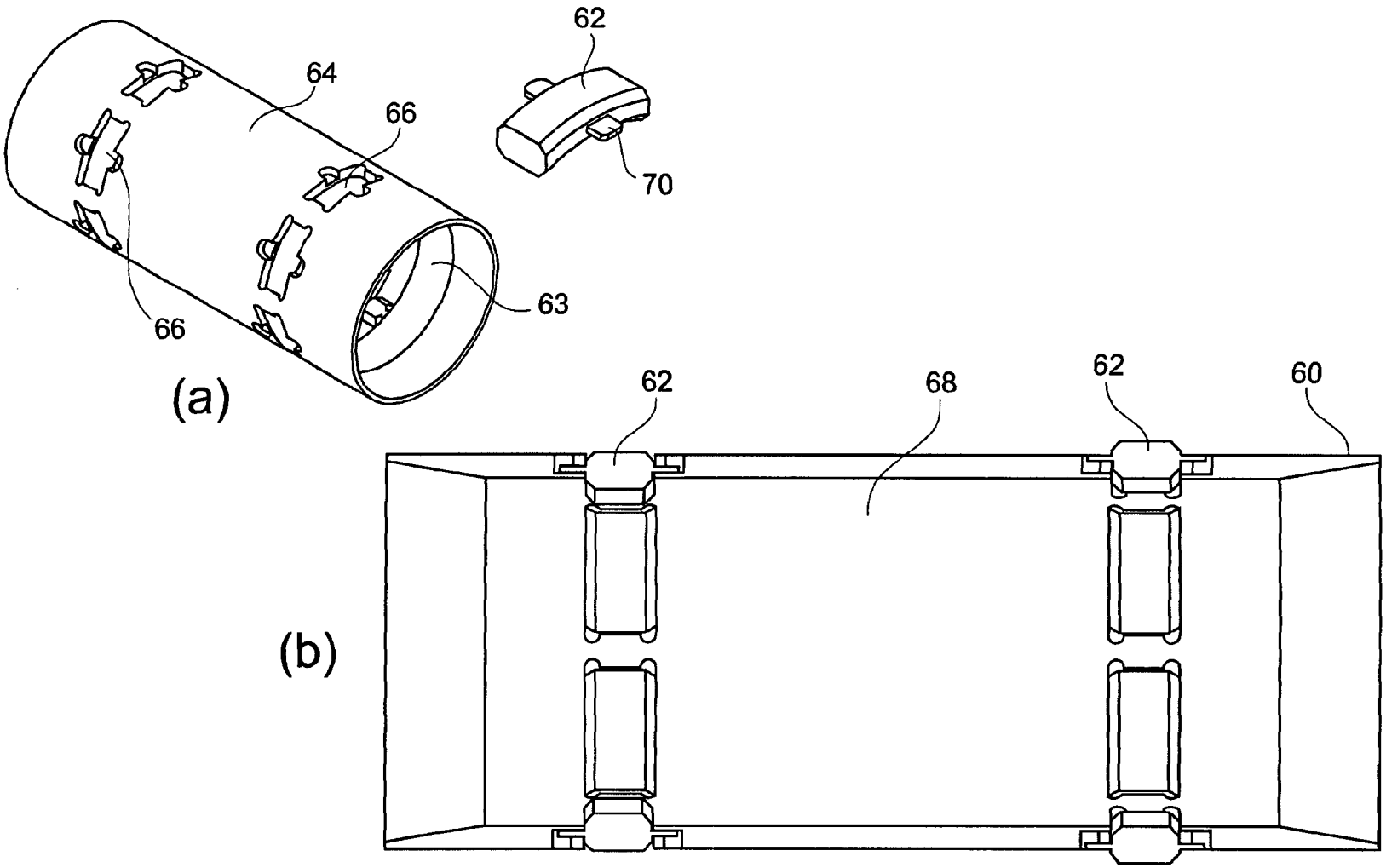
FIG. 8 is a (a) perspective view and a (b) sectional side view of a dog assembly.

FIG. 8 shows an alternative mechanical counting device which is a dog assembly 60 that may be used with the tool 10. In this embodiment, two sets of dogs 62 are provided, rather than the fingers of the collet 20. Each set of dogs 62 are equispaced around the tubular body 64 of the dog assembly 60. As before, the dogs 62 are engagable with recesses 16 of the tool 10.

Each dog 62 comprises a block of material, such as steel which is provided within an aperture 66 of the tubular body 84. Each dog 62 is thicker than the thickness of the tubular body 64 and is movable between a first position in which the under surface of the dog 62 is flush with the inner surface of the tubular body 64 (and so does not protrude into the bore 68 of the tubular body 64) and a second position in which the dog 62 protrudes into the bore 22. FIG. 8 (*b*) shows both positions. Each dog 62 includes two wings 70 to prevent the dog 62 from escaping the aperture 66 and falling into the bore 68.

A dropped ball 30 will contact the dogs 62 of the first set since they are within the bore 68. The dog assembly 60 will then be linearly moved in the travel direction 100 which causes the dogs 62 of the second set to disengage from the recess 16 and linearly move to the second position. At the same time, the dog 62 of the first set will move forward to the first position. The ball 30 is now free to continue forward until it meets the dog 62 of the second set since they are now at the second position.

The dog assembly 60 is then linearly moved as the ball 30 acts upon the dogs 62 of the second set. This causes the dogs 62 of the first set to disengage from the recess 16 and linearly move to the second position. At the same time, the dogs 62 of the second set move forward to engage with the next recess 16. The ball 30 is now free to continue its travel along the well bore, exiting this tool 10.

Whilst specific embodiments of the present invention have been described above, it will be appreciated that departures from the described embodiments may still fall within the scope of the present invention.

What is claimed is:

1. A mechanical counting device locatable within a main bore of a tool which includes a plurality of recesses arranged longitudinally along the main bore, the mechanical counting device comprising:

a collet member having a bore which is sized to permit an object to pass therethrough;

a first set of protrusions which are radially moveable relative to the bore of the collet member between radially extended and refracted positions;

a second set of protrusions which are longitudinally spaced from the first set of protrusions and which are radially moveable relative to the bore of the collet member between radially extended and retracted positions, such that when radially retracted, the protrusions are contactable by an object passing through the collet member, wherein the first and second set of protrusions are configured to interact with the recesses of an associated tool such that, when the protrusions of the first set are engaged with a recess, the protrusions of the second set are not engaged with a recess, and when the protrusions of the second set are engaged with a recess, the protrusions of the first set are not engaged with a recess, wherein the collet member is configured to be linearly progressed along the main bore of an associated tool by a predetermined distance until reaching an actuation site of the tool whereupon the tool is actuated, in response to receiving an object transported through the collet member and sequentially engaging the first and second sets of protrusions.

2. A device as claimed in claim 1, wherein the object comprises a ball.

3. A device as claimed in claim 1, wherein the device is adapted, upon reaching the actuation site of an associated tool, to cause the object to stop at the tool, thus blocking the main bore at the tool.

4. A device as claimed in claim 1, wherein the collet member is adapted to linearly progress in a number of discrete steps to the actuation site in response to receiving a corresponding number of objects transported through the collet member.

5. A device as claimed in claim 4, wherein each discrete step corresponds to the collet member moving from one recess to an adjacent recess of an associated tool.

6. A device as claimed in claim 1, wherein the first and second sets of protrusions are supported by respective first and second sets of fingers.

7. A device as claimed in claim 6, wherein each finger is movable between a first position in which the associated supported protrusion is in a radially extended position and a second position in which the associated supported protrusion is in a radially retracted position and contactable by an object transported through the collet member.

8. A device as claimed in claim 7, wherein each finger is bendable between the first and second positions.

9. A device as claimed in claim 7, wherein the collet member is locatable within the main bore such that the protrusion of one or more fingers is engaged with a recess of an associated tool when the finger is at the first position and not engaged with a recess of the associated tool when the finger is at the second position.

10. A device as claimed in claim 7, wherein the collet member is adapted such that an object passing through the collet member contacts the first set of protrusions when the first set of fingers are at their second position such that the collet member is linearly moved in the direction of travel of the object.

11. A device as claimed in claim 10, wherein the collet member is linearly movable until the first set of protrusions become engaged with a next recess and located at their first position.

12. A device as claimed in claim 11, wherein the collet member is adapted such that engagement of the first set of protrusions with the next recess allows the object to continue past said first set of protrusions.

13. A device as claimed in claim 11, wherein the collet member is adapted such that the linear movement causes the second set of fingers to move from their first position to their second position and permit the second set of protrusions to disengage from a recess.

14. A device as claimed in claim 6, wherein the second set of fingers are longitudinally spaced from the first set of fingers.

15. A device as claimed in claim 1, wherein the collet member is movable towards a sleeve member provided within the main bore of an associated tool and adapted to block a fluid port, and wherein the collet member is adapted to contact and act upon the sleeve member upon reaching the actuation site to move the sleeve member and cause fluid communication between the main bore and the fluid port.

16. A device as claimed in claim 1, wherein the protrusions of the collet member each comprise a dog.

17. A downhole indexing tool, comprising:

a housing defining a main bore and including a plurality of axially spaced circumferential recesses on an inner surface of the housing;

an indexer sleeve defining a through bore and mounted within the main bore of the housing, wherein the indexer sleeve is arranged to linearly progress along said main bore by a predetermine distance in a discrete number of linear movement steps in response to the passage of a corresponding number of objects through the through bore; and first and second arrays of projections, wherein the arrays are arranged axially along the indexer sleeve at an axial spacing such that during a single discrete linear movement step the arrays of projections alternately move between a radially retracted position to be received within a circumferential recess on the housing, and a radially extended position to extend into the through bore of the indexer sleeve, such that passage of an object sequentially engages each array of projections to provide a single discrete linear movement step.

18. The indexing tool of claim 17, wherein the axial spacing between the first and second arrays of projections is fixed.

19. The indexing tool of claim 17, wherein the indexer sleeve and first and second arrays of projections are formed in a unitary component.

20. The indexing tool of claim 17, further comprising an actuatable member to be engaged by the indexer sleeve, such that the indexer sleeve functions to actuate the actuatable member.

21. The indexing tool of claim 20, wherein the actuatable member comprises a sleeve.

22. The indexing tool of claim 20, wherein the actuatable member operates to selectively open a port through a side wall of the housing.

23. A method for downhole actuation, comprising:

providing an indexer sleeve defining a through bore and including first and second arrays of projections;

locating the indexer sleeve within a housing defining a main bore and including a plurality of axially spaced circumferential recesses, wherein the indexer sleeve is initially arranged within the housing such that the projections of the first array are not aligned with a circumferential recess and thus extend into the through bore of the indexer sleeve;

locating the indexer sleeve and housing in a wellbore;

delivering an object into the through bore of the indexer sleeve to engage the projections of the first array to cause the indexer sleeve to move linearly until the projections of the first array become aligned with a circumferential recess and radially retracted into said recess to permit passage of the object, and the projections of the second array being misaligned with a recess and thus extended into the through bore;

engaging the same object with the projections of the second array to cause the indexer sleeve to further move linearly until the projections of the second array become aligned with a subsequent circumferential recess and radially retracted into said subsequent recess to permit passage of the object;

and delivering one or more further objects through the through bore of the indexer sleeve to advance the indexing sleeve further along the housing to reach an actuation site.

24. A downhole tool comprising:

a main bore including a plurality of recesses arranged longitudinally along the main bore; and a mechanical counting device according to claim 1 mounted within the main bore.

* * * * *